US007204406B2

(12) United States Patent
Bone

(10) Patent No.: US 7,204,406 B2
(45) Date of Patent: Apr. 17, 2007

(54) CARTON WITH OUTWARDLY-EXTENDING ACCESS PANEL

(75) Inventor: Larry Bone, Dingmans Ferry, PA (US)

(73) Assignee: Mars Incorporated, McLean, VA (US)

( * ) Notice: Subject to any disclaimer, the term of this patent is extended or adjusted under 35 U.S.C. 154(b) by 266 days.

(21) Appl. No.: 10/627,072

(22) Filed: Jul. 24, 2003

(65) Prior Publication Data

US 2004/0112948 A1 Jun. 17, 2004

Related U.S. Application Data

(60) Provisional application No. 60/398,536, filed on Jul. 24, 2002.

(51) Int. Cl.
*B65D 17/28* (2006.01)
*B65D 5/54* (2006.01)

(52) U.S. Cl. ..... 229/242; 229/122; 229/123

(58) Field of Classification Search ..... 229/122.1, 229/122, 123, 130, 151, 240, 242; 206/736, 206/766, 774; 221/305
See application file for complete search history.

(56) References Cited

U.S. PATENT DOCUMENTS

| | | | | |
|---|---|---|---|---|
| 2,202,280 | A * | 5/1940 | Wilson | 229/151 |
| 2,797,039 | A * | 6/1957 | Belsinger | 229/122 |
| 3,121,511 | A | 2/1964 | Whitehead | 221/283 |
| 3,207,380 | A | 9/1965 | Hennessey | 222/183 |
| 3,265,246 | A | 8/1966 | Messenger | 221/283 |
| 3,278,080 | A | 10/1966 | Di Luco | 221/260 |
| 3,528,597 | A | 9/1970 | Zastrow | 221/17 |
| 3,593,908 | A | 7/1971 | Desmond et al. | |
| 3,747,833 | A | 7/1973 | Robinson | |
| 3,944,128 | A | 3/1976 | Hogan | |
| 4,151,946 | A * | 5/1979 | Schmidt et al. | 229/123 |
| 4,186,866 | A | 2/1980 | Zicko | |
| 4,560,062 | A * | 12/1985 | Valiulis | 206/774 |
| 4,602,735 | A * | 7/1986 | Aaron | 229/122.1 |
| 4,646,937 | A | 3/1987 | Doshi | 221/56 |
| 4,752,029 | A * | 6/1988 | Buford | 229/122.1 |
| 5,458,272 | A | 10/1995 | Ward-Weber | 229/122.1 |
| 5,630,546 | A | 5/1997 | Velch | 229/125.37 |
| 5,813,597 | A * | 9/1998 | Wakevainen | 229/122.1 |
| 5,857,586 | A | 1/1999 | Scherr | 221/45 |
| 6,189,778 | B1 | 2/2001 | Kanter | 229/122.1 |
| 6,213,388 | B1 * | 4/2001 | Ours et al. | 229/215 |
| 6,216,944 | B1 | 4/2001 | Maglione | 229/122.1 |
| 2002/0000463 | A1 | 1/2002 | Jaggi | 229/123 |
| 2003/0098344 | A1 | 5/2003 | Blake | 229/122.1 |
| 2003/0146270 | A1 | 8/2003 | Caille et al. | 229/121 |

FOREIGN PATENT DOCUMENTS

| | | |
|---|---|---|
| DE | 86 26 321.8 | 11/1986 |
| EP | 0 295 503 | 12/1988 |
| EP | 1 329 391 | 7/2003 |

* cited by examiner

*Primary Examiner*—Gary Elkins
(74) *Attorney, Agent, or Firm*—Fitzpatrick, Cella, Harper & Scinto

(57) ABSTRACT

Multi-unit product cartons for store racks, shelves, walls, columns, and floors, in particular, cartons with advantageous product visibility and accessibility via a radially-openable access panel disposed on at least one of the carton sides. The access panel has at least one side arm that inter-leaves between two adjacent carton sides.

21 Claims, 2 Drawing Sheets

CARTON WITH OUTWARDLY-EXTENDING ACCESS PANEL

BACKGROUND OF THE INVENTION

This application claims the benefit of U.S. Provisional Patent Application No. 60/398,536 filed on Jul. 24, 2002, the specification of which is incorporated herein in it's entirety.

FIELD OF THE INVENTION

The present invention relates to multi-unit product cartons for, e.g., store racks and shelves. The invention provides, in particular, cartons with advantageous product visibility and accessibility via an outwardly-extending access panel disposed on at least one of the carton panels. The access panel has at least one side arm that inter-leaves with at least one adjacent panel, preferably between two adjacent panels. The invention may also be utilized as a stand alone multi-unit product carton for floor and/or counter placement. The invention may also be hung using double-sided adhesives, hook and loop fastening means, and/or hook means.

RELATED BACKGROUND ART

Product manufacturers and distributers, hereinafter "sellers", sell a majority of their products in retail and wholesale stores. Since product display space in these stores is often limited and densely occupied, sellers compete for space on store shelves, floors, walls, columns, and counters. Further, since high product visibility and ease of product accessibility is a major factor in product sales, sellers also compete for certain areas on shelves, floors, and the like. As a result, consumer eye level and other high visibility areas in stores are highly sought after. Unfortunately, high visibility display space is even more limited than general display space.

The inability of a product seller to secure product placement in high visibility areas may lead to lack of consumer awareness of the sellers' product, reduced sales, and loss of sales revenue. Low product sales may lead to a product being "pulled" from store shelves in order to make space available for presumed better selling products. Limited store space leads to other problems as well.

Since store space, especially shelf space, is so limited, stores often provide only enough clearance between shelves or racks to accommodate the products or product containers intended to fit within that space. As a result, the product container tops practically, if not actually, abut the shelf or rack situated above the shelf or rack on which they sit. In the case of product containers or cartons, a consumer must reach into a small space between the container or carton and the shelf above it to take an individual product. The effort may require the consumer to engage in physical manipulation of their hands and or stance resulting in reduced carry away ease. Worse yet, the product may not be seen, and, therefore, passed over completely.

Sellers have attempted to address product visibility problems by providing product containers with artwork that makes the containers more readily visible by the consumer. Now, however, since nearly all sellers utilize the same methods of making their products more visible, individual containers again become unobvious amidst a virtual sea of brightly decorated product cartons and containers. Sellers have also designed product containers or cartons with larger top openings in order to increase individual product accessibility. However, depending on the clearance between product container or carton tops and the shelf or rack above, most, if not all, of these containers still require the consumer to crouch and/or manipulate their hands in order to carry a product away. Sellers have also designed cartons with access panels, dispensation areas, and hanging means. See, e.g., U.S. Pat. Nos. 3,121,511; 3,207,380; 3,265,246; 3,278,080; 3,528,597; 3,593,908; 3,747,833; 3,944,128; 4,186,866; 4,646,937; 5,458,272; 5,857,586; 6,189,778; 6,216,944; and, European Patent No. 0 295 503. Unfortunately, many of the prior art cartons are of non-integral construction, waste construction material, cannot be placed on a rack with a lip and allow the access panel to remain operable, are not specifically designed for increased visibility on a shelf or rack, or have combinations of these drawbacks.

Accordingly, the need remains for a way to package, display, and dispense multiple individual product units in a way that allows them to be more obvious to a consumer observing a store section having products in the same category, especially when the products are not at eye level. There also remains a need to increase consumer accessibility of individual products housed within a product container or carton especially when the product container is in crowded or cramped display area.

SUMMARY OF THE INVENTION

The present invention is directed to a simple, effective, and cost conscious way to package, display, and dispense a group of products in a way that allows them to be more obvious to a consumer observing a store section having similar products and to increase consumer accessibility of individual products housed within a product container or carton.

A first embodiment is a unitary carton for improved product visibility having a radially-openable access panel integrally hinged to a lip accommodation panel disposed on a portion of an inner side of a front panel having a front access opening, the radially-openable access panel covering at least a portion of the front access opening when in a closed position, a bottom panel connected to at least one back panel, and at least two opposing side panels connected to the bottom panel, wherein the front panel has two integrally connected and opposing front panel flaps, each disposed on an inner side of the side panels, and the access panel has disposed thereon at least one sidearm that is capable of interleaving between the side panels and the front panel flap.

A second embodiment is a unitary carton blank for forming a display carton having improved product visibility, said carton blank comprising:

a front access panel, 15, having two side arms, 20, each integrally connected to opposing sides of said access panel, and an inner rack lip accommodation panel, 40, having a topside and a bottom side, said top side of said inner rack lip accommodation panel integrally connected to a bottom side of said front access panel;

a bottom panel, 60, having a front side and an opposing rear side, said front side of said bottom panel integrally connected to said bottom side of said inner rack lip accommodation panel, and said bottom panel having two inner side panels, 50, each integrally connected to opposing sides of said bottom panel;

a back panel, 70, having a top side and a bottom side, said bottom side of said back panel integrally connected to said rear side of said bottom panel, and said back panel having two back panel side flaps, 80, each integrally connected to opposing sides of said back panel;

a top panel, 95, having a front side and a rear side, said rear side of said top panel integrally connected to said top side of said back panel, and said top panel having two outer side panels, 90, each integrally connected to opposing sides of said top panel;

a front panel lip, 200, having a top side and a bottom side, said top side of said front panel lip integrally connected to said front side of said top panel and said bottom side of said front panel lip defining a top boundary of an access panel opening, 170, said front panel lip having two front panel side flaps, 190, an upper portion of each front panel side flap integrally connected to opposing sides of said front panel lip; and, an outer rack lip accommodation panel, 180, having a top side and a bottom side, said top side of said outer rack lip accommodation panel defining a bottom boundary of said access panel opening, and a lower portion of each front panel side flap integrally connected to opposing sides of said outer rack lip accommodation panel.

Unless otherwise stated, all units of measure are standard SI units. Any cited documents are, in relevant part, incorporated herein by reference. Various alterations to the present invention will be apparent to a skilled artisan upon viewing the figures and reading the specification including the claims appended hereto.

DETAILED DESCRIPTION OF THE FIGURES

DETAILED DESCRIPTION OF THE INVENTION

Figure 1:
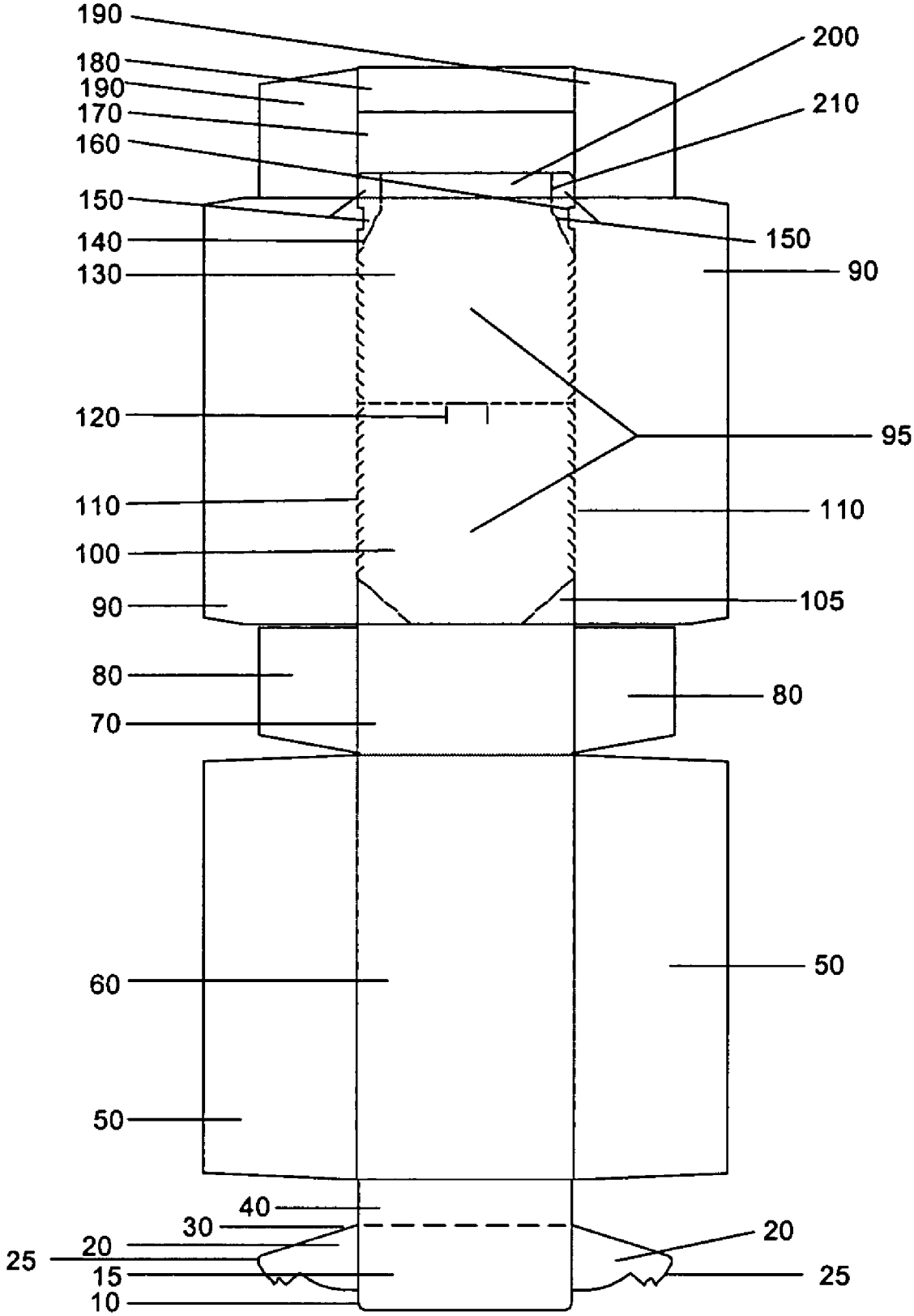
FIG. 1 is a top view of a preferred embodiment in a flat and unaffixed state. Specifically, it is a carton blank as it would leave a die-cut machine.

As used herein, the term "product display unit", "carton", or "container" is intended to mean any container designed to hold two or more individual product units. Construction materials include, but are not limited to, paperboard, corrugated paperboard, cardboard, and plastic. Other construction materials will be apparent to a skilled packaging artisan.

As used herein, the term "radial", as it relates to the operation of the inventive access panel, is intended to mean the access panel operates in much the same manner as a door; whereby when it is opened or closed, its path is that of a pie slice with an arc defining its outermost path boundary. The access panel preferably opens only a predetermined amount. Preferably, the fully-opened access panel forms an arc with an angular value of less than about 90° in relation to its closed position. More preferably, the arc formed has an angular value between about 30° and about 60°, even more preferably between about 40° and about 50°, and most preferably about 45°.

As used herein, the term "interleave" and its various forms, is intended to refer to the sandwiching of a panel between at least two panels whereby the sandwiched panel is capable of being moved without interference from products contained in a carton and/or other carton panels.

Product cartons serve a primary role in the shipment of product units for individual sale. Cartons also provide a simple means to quickly stock store shelves or racks with multiple retail units without handling numerous individual retail units. Product cartons also provide containment means for multiple product units placed on store counters, walls, and floors. For example, candy bars and other snack foods would take an inordinate amount of time to shelf-stock if they were not packed 25 to 30 per carton. Instead, the top of the carton is tom along perforations to form an opening; and, the entire carton is placed on the shelf or rack.

However, as discussed hereinbefore, current product cartons pose an obstacle to attaining consumer attention and easing consumer accessibility. It has been surprisingly discovered that an outwardly-extending panel disposed on at least one of the carton sides can provide both increased product visibility as well as ease of consumer accessibility while providing cost-effective manufacturing and erection procedures. While the following discussion will focus primarily on cartons that are rectangular in shape, the inventive access panel can work for other carton shapes including triangular and circular or spherical without departure from the spirit and scope of the invention. The cartons may also be equipped with means for affixing the carton to a wall, shelfless display rack, e.g., pegboard rack, column, or other display area. The means may include, for example, double-sided tape, hook and loop fastener means, e.g. Velcro®, and carton apertures designed to accommodate a peg in a pegboard rack, or an s-hook for hanging on an aperture-containing surface.

The inventive access panel is preferably an integral portion of the carton blank since it provides ease of manufacturing and assembly. In any regard, the panel opens in a radial manner, preferably to a predetermined amount, and disengagably-locks into position. The predetermined opening amount can be controlled with at least one, preferably two, side arms disposed on the access panel. The side arm preferably disengagably-locks into position via at least one holding means disposed on at least one side arm and at least one aperture in one of the carton panels wherein the aperture is designed to disengagably-receive the holding means. Preferably, the holding means is a notch. In this manner, the access panel may be opened and closed repeatedly.

A preferred embodiment of a unitary un-erected carton blank in accordance with the present invention is shown in FIG. 1. An un-erected carton blank is one that is removed from the die-cutting machine without assembly or affixation of any of the panels. The inventive access panel, 15, is equipped with preferred inter-leaving side arms, 20, which have disposed thereon preferred side arm notches, 25. The carton blank is preferably partially assembled or assembled flat prior to receipt at a product packing station.

In order to partially assemble the carton blank such that it remains flat, the carton is folded, carton outside out, between back panel, 70, and the perforated rear top panel, 100. Next, while bending, carton outside out, between the optional inner rack lip accommodation panel, 40, and bottom panel, 60, optional access panel lip, 10, is inserted from the inner side into access panel opening, 170, such that access panel lip, 10, is on the outer side of front panel lip, 200, while the access panel, 15, covers access panel opening, 170, and inner rack lip accommodation panel, 40, is on the inner side of optional outer rack lip accommodation panel, 180. Once a fixative, such as glue, sets between the inside of optional outer rack lip accommodation panel, 180, and the outside of optional inner rack lip accommodation panel, 40, and, between the outside of optional front panel lip, 200, and the inside of access panel lip, 10, carton flat assembly is complete.

The height of inner and outer rack lip accommodation panels, 40 and 180 respectively, may be reduced, increased, or eliminated depending on the height of the rack lip to be overcome or if counter or floor placement is anticipated. If inner and outer rack lip accommodation panels, 40 and 180 respectively, are eliminated, access panel opening, 170, can be extended towards the bottom of the container; and, portions similar to the accommodation panels may be designed to be affixed to the bottom of the container if the extra support is required.

Figure 2:
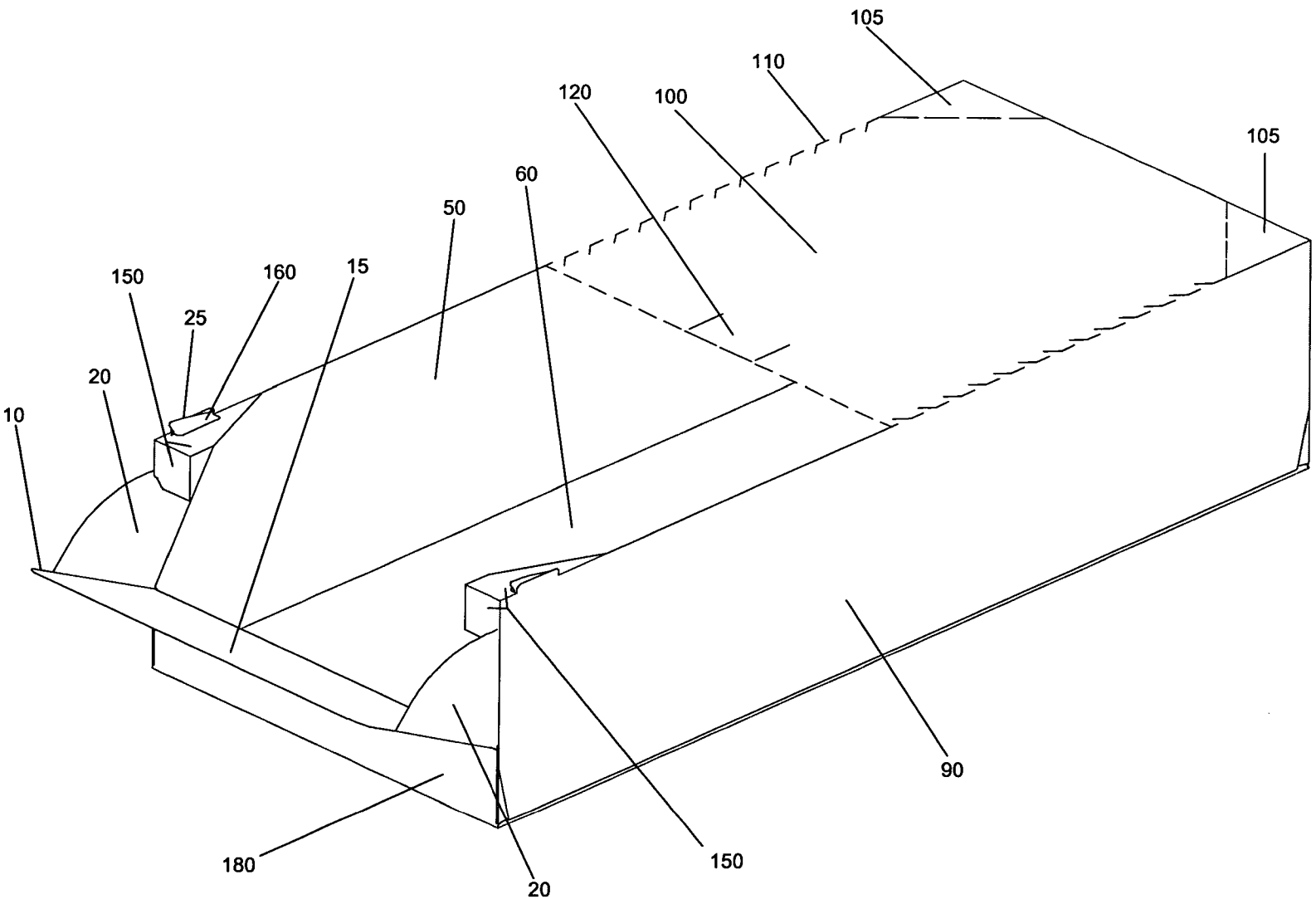
FIG. 2 is an isometric view of a preferred embodiment in an erected state with the panel open. This is the way the carton would look open on a store shelf although the store shelf is not depicted.

The top panel, 95, of the inventive carton may have two or more portions that may be selectively and controllably torn along perforations or other means. FIG. 1 depicts two such portions: rear top panel, 100, and front top panel, 130. The portions allow flexible display capabilities such as providing display cartons with tops that may be closed, partially open, or substantially open depending on specific display needs. The inventive carton preferably also includes two opposing rear top corner supports, 105, as shown in FIGS. 1 and 2. Each corner support is preferably disposed between rear top panel, 100, outer side panels, 90, and back panel, 70. The corner supports provide a brace for inhibiting the carton from separating at the rear corners, particularly when stacked.

The inventive carton preferably includes front/top corner assembly, 150, as shown in FIGS. 1 and 2. The corner assembly may be provided, for example, by an integral or non-integral segment of construction material adjoining front panel side flap, 190, and outer side panel, 90, in a manner that, when the carton is assembled as shown in FIG. 2, the corner assembly is folded and forms an anchoring point for preferred inter-leaving side arm, 20. The side arm is anchored in the corner assembly when the access panel is opened far enough that inter-leaving side arm, 20, contacts the corner assembly. A skilled artisan can adjust the angular orientation of inter-leaving side arm, 20, to alter the amount the access panel may be opened. The corner assembly may also have disposed thereon optional side arm notch-receiving aperture, 160, for receiving optional side arm notch, 25. The aperture may be formed, for example, by cutting a suitably-sized area between corner assembly, 150, and outer side panel, 90. When the carton is erected and the access panel is opened completely, side arm notch, 25, will protrude through notch-receiving aperture, 160.

Prior to loading the flat-assembled carton with product, the carton must be erected. To erect the carton, one of inner side panels, 50, is folded, outside out, towards rear top panel, 100, and front top panel, 130, without enclosing interleaving side arm, 20, or front panel side flap, 190. Interleaving side arm, 20, is then folded, outside out, towards already folded inner side panel, 50. Front panel side flap, 190, is folded, outside out, towards already folded interleaving side arm, 20. Back panel side flap, 80, is then folded, outside out, towards already folded inner side panel, 50. Lastly, outer side panel, 90, is folded, outside out, towards already folded inner side panel, 50, sandwiching front panel side flap, 190, interleaving side arm, 20, and back panel side flap, 80, there-between. With fixative set between outer side panel, 90, back panel side flap, 80, front panel side flap, 190, and, optionally but preferably, inner side panel, 50, the carton is assembled erect. The above-described erection procedure is but one method; and, it is possible to rearrange or eliminate at least some of the steps. Moreover, one skilled in the art will recognize that front panel side flaps, 190, back panel side flaps, 80, and the areas on outer side panels, 90, and inner side panel, 50, that corresponds to those side flaps may be crushed to achieve a better fixative connection between the front side panel and the back side panel.

With the carton assembled erect, it may be filled through the remaining open side with product, specifically, with two or more individual product units. Once filled with product, the open side is closed in accordance with the above-described steps for erecting the carton. After the open side is closed, the carton may be optionally wrapped with a protective material such as plastic, stacked with other filled cartons in a columnar fashion and wrapped with a protective material such as plastic and/or strapped together, and/or palletized along with other product-filled cartons/carton columns and wrapped with a protective material such as plastic and/or strapped together prior to shipping. Pre-pack embodiments of the present invention are preferred, i.e., embodiments where the cartons are shipped to the point-of-sale filled with product and ready for display after opening the cartons.

Upon arriving at a store, a product-filled carton will be opened prior to/concurrently with placing the carton on a store shelf, floor, wall, or counter. To open a carton, a finger or implement is pushed into preferred perforated assistance flap, 120, and perforated front top panel, 130, is pulled and torn, along preferred front top panel perforations, 140, including the perforations disposed between perforated front top panel, 130, and front panel lip, 200. Optional front panel lip perforations, 210, are then torn thereby allowing access panel, 15, to become outwardly-openable. Alternatively, front top panel, 130, is pulled and torn, along preferred front top panel perforations, 140, and used to pull access panel, 15, open. If desired, front top panel, 130, may be sized to be left connected to front panel lip, 200, and hanging therefrom for increased attention garnering. Obviously, if this is the case, the inner side of front top panel, 130, may be printed with graphics for consumer eye appeal. Whether or not front top panel, 130, is designed to remain attached to front panel lip, 200, the inner side of access panel, 15, may be printed with graphics for increased attention garnering. Alternatively or additionally, a folded flyer may be attached to access panel, 15, whereby the folded flyer may be unfurled after the access panel is opened. The folded flyer can serve as an additional means for attention garnering and may be made from a variety of flexible or semi-rigid printable construction materials. If the carton comprises optional perforated rear top panel, 100, it too may be pulled and torn away from the carton along optional rear top panel perforations, 110, if a completely open top is desired. With the carton open and the access panel, 15, operable, the carton may be placed on the store floor, counter, rack, column, or wall.

Many, if not all, inclinedly-hanging store racks have lips disposed on the front of the rack in order to keep items placed there from sliding off and onto the floor in front of the rack. Rack lips are typically of standard heights for varying depth racks with many of them being less than 1.25 inches in height. Inner rack lip accommodation panel, 40, and outer rack lip accommodation panel, 180, are preferably sized to clear the tops of rack lips such that access panel, 15, can be outwardly-opened by bending at optional access panel fold line, 30, without interference from the rack lip. With the carton in place, the access panel can be outwardly-opened until optional side arm notches, 25, engage optional side arm notch-receiving apertures, 160. The products contained in the cartons are now ready to be carried away by the consumer.

The carton panels including the access panel may include printed information on one or both sides such that printed information may be viewed on the outside and inside of the carton. Such information is generally related to type, amount, color, flavor, etc., of the product contained within the carton. For example, the inside bottom of the carton may contain a statement to the effect that re-stocking is required.

All carton components or a unitary carton may be manufactured from corrugated paperboard components, or the like, produced with cutting dies and printing plates according to processes well known to the skilled artisan. With such processes, sheets of material are cut into flat panels which are later folded and affixed together to form the carton as, for example, hereinbefore described.

A variety of fixatives may be used which are sufficient for affixing paperboard or an equivalent material. It is preferable, however, that a quick-setting adhesive be used since the folded portions of the shell are under stress and tend to unfold when placed in the folded position and released.

An example of such a quick setting adhesive is a heat sensitive adhesive, applied when the adhesive is in a melted condition. When adhering two surfaces together, melted adhesive is applied to the first surface, then the second surface is placed in immediate contact with the first surface. The melted adhesive quickly solidifies shortly after the two surfaces are brought together since the ambient temperature of the surfaces cool the adhesive almost immediately after joining. Preferably, the panels to be adhered together are held under compression for a period of time until the adhesive has set. Of course, panels may be affixed by machine as can be appreciated by a skilled artisan.

As one of ordinary skill in the art will appreciate, the panels may also be joined by including interlocking portions on the panels. For example, one surface may include a cut-out or slot for receiving a corresponding locking member from another surface for connection thereto. Moreover, additional panels may be included, which, when folded over, keep an enclosed panel secure.

The assembled shell includes a closed bottom and, optionally, a top which can be a partially closed top or a substantially closed top. The optional top may include readily removable portions which may be pulled back and/or torn off to expose product from the top. In a preferred embodiment, the optional top includes a center opening that can accommodate a finger or tool to ease the opening of a top and/or pre-existing perforations to help control tearing.

In another embodiment of the present invention, a separate slip-off, corrugated cover may be provided that is slipped over a filled display carton having an open top, in order to keep dust and particles off the contents of the tray. Such a cover may have one or more sides integral with a side(s) of the shell.

After the panel members are placed in their respective positions within the carton, and, preferably, affixed with adhesive, the carton is filled with product. The filled cartons can then, as stated before, be stacked in columns and palletized in multiple columns for shipment to stores. Multiple types of products may be packaged together. For example, when packaging candy, a different flavor may be in each display, so that a consumer may readily obtain any of the display candies.

Carton assembly, erection, packing, and closing may be fully automated using box making equipment familiar to one of ordinary skill in the art. Such equipment automatically applies the adhesive, erects the carton, fills the carton with product, and folds and affixes the final panels.

After packaging and final assembly, the cartons may be stacked in single columns or palletized in multiple columns. Each carton in each column may also be covered with the slip-on or integral cover for shipping. In addition or alternative to the slip-on cover, the cartons, columns, and/or pallets may be covered with a stretch or shrink wrap for shipping. Stretch wrap over a column and/or pallet of cartons helps increases stability during shipping.

Other embodiments of the present invention will be apparent to the skilled artisan. While the appended claims distinctly point to specific embodiments, embodiments falling within the spirit and scope of the preceding specification are also encompassed.

What is claimed is:

1. A unitary carton for improved product visibility comprising a radially-openable access panel integrally hinged to a lip accommodation panel disposed on a portion of an inner side of a front panel having a front access opening, said radially-openable access panel covering at least a portion of said front access opening when in a closed position, a bottom panel connected to at least one back panel, at least two opposing side panels connected to said bottom panel, and a top panel joined at perforations to said side panels and joined to said back panel that is removable in whole or in part along said perforations to expose product through the top of the carton, wherein said front panel has two integrally connected and opposing front panel flaps, each disposed on an inner side of said side panels, and said access panel has disposed thereon at least one sidearm for interleaving between the inner side of one of said side panels and one of the front panel flaps disposed on the inner side of said side panels.

2. A carton according to claim 1 further comprising a product protection covering.

3. A carton according to claim 1 wherein the top panel is joined to said side and back panels to form an at least partially closed carton.

4. A carton according to claim 3 wherein said top panel forms a closed carton.

5. A carton according to claim 4 wherein said top panel comprises more than one panel defining portions of said top panel that can be selectively opened.

6. A carton according to claim 5 wherein said portions of said top panel that can be selectively opened are defined by perforations that may be selectively and controllably-torn.

7. A carton according to claim 1 further comprising means for affixing said carton to a surface.

8. A carton according to claim 1 wherein said access panel comprises at least two side arms.

9. A carton according to claim 1 wherein said side arm comprises at least one holding means to hold said access panel in a predetermined open position.

10. A carton according to claim 9 wherein said holding means comprises at least one notch in at least one of said side arms, wherein said notch engages at least one aperture in said top panel.

11. A carton according to claim 1 wherein said carton is constructed of paperboard.

12. A carton according to claim 1 wherein the front access opening of said front panel and said top panel when removed in whole or in part form a continuous opening to expose product through the top of the carton.

13. A unitary carton blank for forming a display carton having improved product visibility, said carton blank comprising:

a) a front access panel, (15), having two side arms, (20), each integrally connected to opposing sides of said access panel, and an inner rack lip accommodation panel, (40), having a topside and a bottom side, said top side of said inner rack lip accommodation panel integrally connected to a bottom side of said front access panel;

b) a bottom panel, (60), having a front side and an opposing rear side, said front side of said bottom panel integrally connected to said bottom side of said inner rack lip accommodation panel, and said bottom panel having two inner side panels, (50), each integrally connected to opposing sides of said bottom panel;

c) a back panel, (70), having a top side and a bottom side, said bottom side of said back panel integrally connected to said rear side of said bottom panel, and said back panel having two back panel side flaps, (80), each integrally connected to opposing sides of said back panel;

d) a top panel, (95), having a front side and a rear side, said rear side of said top panel integrally connected to said top side of said back panel, and said top panel having two outer side panels, (90), each integrally connected to opposing sides of said top panel;

e) a front panel lip, (200), having a top side and a bottom side, said top side of said front panel lip integrally connected to said front side of said top panel and said bottom side of said front panel lip defining a top boundary of an access panel opening, (170), said front panel lip having two front panel side flaps, (190), an upper portion of each front panel side flap integrally connected to opposing sides of said front panel lip; and, f) an outer rack lip accommodation panel, (180), having a top side and a bottom side, said top side of said outer rack lip accommodation panel defining a bottom boundary of said access panel opening, and a lower portion of each front panel side flap integrally connected to opposing sides of said outer rack lip accommodation panel.

14. A carton blank according to claim 13 further comprising an opening assistance flap, (120), disposed on said top panel.

15. A carton blank according to claim 13 further comprising two front/top corner assemblies, (150), each disposed between front top panel, (130), and outer side panels, (90), and between front panel lip, (200), and front panel side flaps, (190).

16. A carton blank according to claim 15 wherein said front/top corner assemblies each comprise at least one side arm notch-receiving aperture, (160).

17. A carton blank according to claim 16 wherein said side arms each comprise at least one side arm notch, (25), wherein said notch is designed to be received in said aperture when said carton is erected and said access panel is in the open position.

18. A carton blank according to claim 13 further comprising means for affixing said carton to a surface.

19. A carton blank according to claim 13 wherein said top panel comprises a rear top panel, (100), and a front top panel, (130).

20. A carton blank according to claim 19 wherein said top panel comprises two opposing rear top corner supports, (105), each disposed between said rear top panel, (100), said outer side panels, (90), and said back panel, (70).

21. A carton blank according to claim 13 wherein said carton is constructed of corrugated paperboard.

* * * * *